US011649813B2

(12) United States Patent
Gunn et al.

(10) Patent No.: US 11,649,813 B2
(45) Date of Patent: May 16, 2023

(54) CONDENSATE VAPORIZATION SYSTEM

(71) Applicant: CLARK EQUIPMENT COMPANY, Statesville, NC (US)

(72) Inventors: John Thomas Gunn, Charlotte, NC (US); Richard Louis Kouzel, Mooresville, NC (US)

(73) Assignee: CLARK EQUIPMENT COMPANY, Statesville, NC (US)

( * ) Notice: Subject to any disclaimer, the term of this patent is extended or adjusted under 35 U.S.C. 154(b) by 13 days.

(21) Appl. No.: 17/108,837

(22) Filed: Dec. 1, 2020

(65) Prior Publication Data

US 2021/0079909 A1 Mar. 18, 2021

Related U.S. Application Data

(63) Continuation of application No. 14/860,037, filed on Sep. 21, 2015, now abandoned.

(51) Int. Cl.
*F04B 39/16* (2006.01)
*F04C 29/02* (2006.01)

(52) U.S. Cl.
CPC ..... *F04B 39/16* (2013.01); *F04C 29/02* (2013.01); *F04C 29/026* (2013.01)

(58) Field of Classification Search
CPC .. F04B 39/16; F04B 39/0207; F04B 39/0223; F04C 29/026; F04C 29/0092; B01D 1/0011; B01D 1/0017; B01D 5/0009
(Continued)

(56) References Cited

U.S. PATENT DOCUMENTS 3,810,346 A 5/1974 Uratani
4,055,403 A * 10/1977 Strauss ..... B01D 53/26 96/240

(Continued)

FOREIGN PATENT DOCUMENTS

DE 4445972 6/1995
GB 2158562 11/1985

(Continued)

OTHER PUBLICATIONS

Extended European search report from the European Patent Office for Application No. 16189687.3 dated Jan. 25, 2017 (10 pages).

(Continued)

*Primary Examiner* — Kenneth J Hansen
(74) *Attorney, Agent, or Firm* — Michael Best & Friedrich LLP

(57) ABSTRACT

An air compressor system includes a compressor having an intake end and a discharge end, the compressor operable to draw in atmospheric air at the intake end and to discharge a flow of compressed air from the discharge end, the flow of compressed air including a flow of entrained water vapor and lubricant. The system further includes a separator operable to remove a portion of the entrained water vapor and lubricant from the flow of compressed air, the separator discharging a flow of dry compressed air and a flow of effluent which includes the separated water vapor and lubricant. Further, the system includes an electric heater configured to receive the removed effluent from the separator at an entrance to the electric heater and to vaporize the removed effluent.

14 Claims, 2 Drawing Sheets

(58) Field of Classification Search
USPC ..... 55/428.1, 431
See application file for complete search history.

(56) References Cited

U.S. PATENT DOCUMENTS

| | | | | |
|---|---|---|---|---|
| 4,324,565 | A | 4/1982 | Benkmann | |
| 5,230,222 | A | 7/1993 | Erbs | |
| 5,302,300 | A * | 4/1994 | Porri | B01D 5/009 95/40 |
| 5,318,151 | A | 6/1994 | Hood et al. | |
| 5,624,236 | A | 4/1997 | Kubo et al. | |
| 5,906,714 | A | 5/1999 | Gramkow et al. | |
| 6,015,260 | A | 1/2000 | Marichal | |
| 6,402,937 | B1 | 6/2002 | Shaffer, Jr. et al. | |
| 6,550,258 | B1 | 4/2003 | Shoulders | |
| 7,815,711 | B2 | 10/2010 | Van Hove | |
| 2003/0037679 | A1 * | 2/2003 | Kitchener | F04C 29/0092 96/270 |
| 2008/0105125 | A1 | 5/2008 | Lauson et al. | |
| 2013/0333781 | A1 | 12/2013 | Itadani | |
| 2014/0165633 | A1 | 6/2014 | De Piero et al. | |

FOREIGN PATENT DOCUMENTS

| | | |
|---|---|---|
| JP | 2005048593 | 2/2005 |
| WO | 2004036048 | 4/2004 |

OTHER PUBLICATIONS

European Communication Pursuant to Article 94(c) EPC dated Jan. 18, 2019 for related European Application No. 16189687.3.

* cited by examiner

CONDENSATE VAPORIZATION SYSTEM

CROSS-REFERENCE TO RELATED APPLICATIONS

This application is a continuation of U.S. patent application Ser. No. 14/860,037, filed on Sep. 21, 2015 and entitled "Condensate Vaporization System," the contents of which is hereby incorporated by reference in its entirety.

BACKGROUND

The present invention relates to a system for vaporizing effluent discharged from a compressor.

Compressors are used to compress gas for use in various processes. Some compressors use oil as a lubricant and a coolant during compressor operation. The oil lubricates and seals the compressor and carries away excess heat during use. A small portion of the oil is typically discharged with the flow of compressed gas that is discharged from the compressor. In compressor systems that compress air, the air is typically drawn from the atmosphere and therefore contains at least some water vapor. During the compression process, some of this water vapor can condense out of the compressed air and be carried out of the air compressor with the small quantity of oil, especially in applications where the compressed service air is cooled prior to discharge.

SUMMARY

In one construction of an air compressor system, the system includes a compressor having an intake end and a discharge end, the compressor operable to draw in atmospheric air at the intake end and to discharge a flow of compressed air from the discharge end, the flow of compressed air including a flow of entrained water vapor and lubricant. Additionally, the system includes a separator operable to remove a portion of the entrained water vapor and lubricant from the flow of compressed air, with the separator discharging a flow of dry compressed air and a flow of effluent which includes the separated water vapor and lubricant. Further, the system includes an electric heater configured to receive the removed effluent from the separator at an entrance to the electric heater and to vaporize the removed effluent.

In another construction of an air compressor system, the system includes an oil-flooded compressor having an intake end for the intake of air and a discharge end from which a compressed air stream with entrained effluent exits the compressor. Additionally, the system includes an electric motor coupled to the compressor and operable to drive the compressor. Further, the system includes an after cooler coupled to the discharge end of the compressor and operable to cool the compressed air stream and effluent to condense a portion of the effluent and a moisture separator coupled to a discharge end of the after cooler and configured to remove a portion of the condensed entrained effluent from the compressed air stream. Even further, the system includes an electric pass-through heater configured to receive the removed effluent from the moisture separator, and configured to vaporize the removed effluent.

Another construction provides a method of operating an electrically-powered air compressor. The method includes powering an oil-flooded compressor with an electric motor, the compressor producing a flow of compressed air and effluent, the effluent including compressed water vapor and oil, cooling the flow of compressed air and effluent to condense a portion of the effluent, and separating the flow of compressed air and effluent into a flow of dry compressed air and a flow of condensed effluent. The method further includes heating the flow of condensed effluent in an electrically-powered heater to vaporize the effluent and discharging the vaporized effluent to the atmosphere.

Other aspects of the invention will become apparent by consideration of the detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations herein are meant to encompass the items listed thereafter and equivalents thereof as well as additional items.

DETAILED DESCRIPTION

Figure 1:
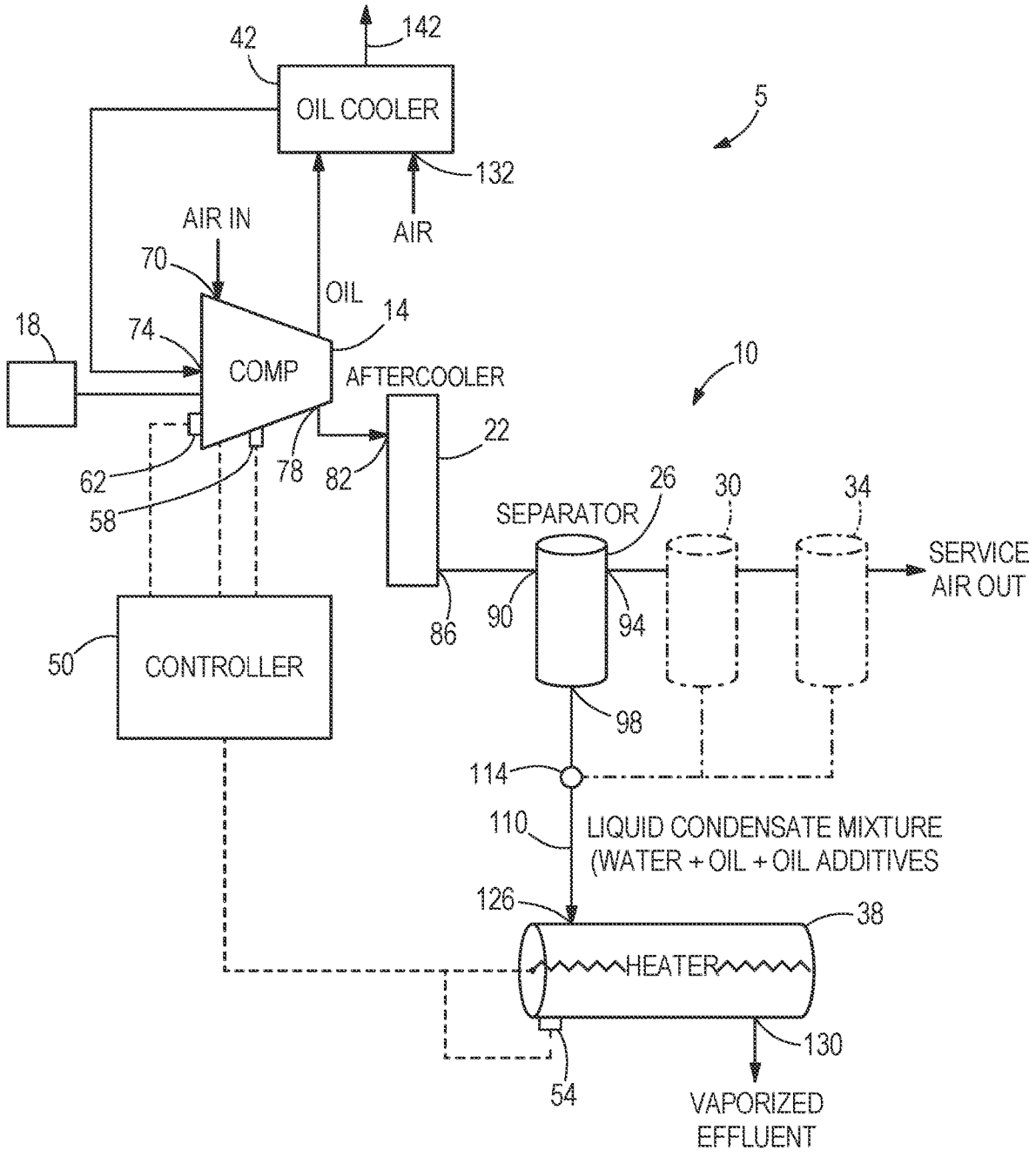
FIG. 1 is a schematic illustration of a condensate vaporization system.

FIG. 1 schematically illustrates a compressor system 5, including a condensate vaporization system 10 and a particulate removal system 15, for producing a compressed gas stream and for removal of entrained effluent from the compressed gas stream to produce a stream of clean compressed gas that contains minimal moisture and lubricant. Effluent is generally defined as a mixture of water and oil (i.e., primarily water with a small amount of entrained lubricant), and is essentially the liquid medium that resides downstream of an aftercooler in a compressor system. Before proceeding further, it should be noted that the present system can be used to compress many different gasses. However, for clarity, the system will be described herein as it applies to an air compressor system. The compressor system 5 includes a compressor 14, a motor 18, an aftercooler heat exchanger 22, a controller 50, a compressor temperature sensor 58, a compressor pressure sensor 62, an ambient air temperature sensor 66, and an ambient air relative humidity sensor 68. The particulate removal system 15 of the compressor system 5 includes a separator 26 and first and second filters 30, 34. The condensate vaporization system 10 of the compressor system 5 includes an electric heater 38, and a heater temperature sensor 54.

In the illustrated construction, the compressor 14 is an oil flooded screw compressor. The compressor 14 includes a compressor air inlet 70 open to the atmosphere. The compressor 14 further includes a compressor discharge end 78. The motor 18 couples to the compressor 14 and is operable to drive the compressor 14. In the illustrated construction, the motor 18 is an electric motor that electrically couples to a power source (not shown). In other constructions the motor 18 can be another prime mover operable to drive the compressor 14.

The aftercooler 22 includes an aftercooler inlet 82 that receives a flow of compressed air from the compressor 14 and an aftercooler outlet 86 where the cooled compressed air is discharged. Additionally, the aftercooler 22 fluidly couples to a cooling source with a cooling fluid (e.g., air, coolant, water) that passes through the aftercooler 22 such that the cooling fluid thermally communicates with compressed air that is within the aftercooler 22 between the aftercooler inlet 82 and the aftercooler outlet 86.

The aftercooler 22 discharges the cooled flow of compressed air to the separator 26 (e.g., a moisture separator or water separator). The separator 26 includes a separator inlet 90, a first separator outlet 94, and a second separator outlet 98. The second separator outlet 98 couples to a discharge line 110.

Downstream of the aftercooler 22 are the first and second filters 30, 34. In the illustrated construction, the first and second filters 30, 34 are coalescing filters. In other constructions, other types of filters can be used to remove excess liquid from the compressed air. Further, in some constructions more than two filters, or fewer filters can be utilized, or no filters may be utilized.

Each filter 30, 34 has a filter inlet, an air outlet, and a condensed effluent outlet. The air outlet of the first filter 30 fluidly couples to the second filter 34. The air outlet of the second filter 34 is connected to other downstream components that ultimately lead to a point of use. For example, a storage tank or large manifold could be connected to the filter 34 to hold a quantity of compressed air for use as may be required. The condensed effluent outlets of the first and second filters 30, 34 couple to the discharge line 110.

The discharge line 110 includes an orifice 114 which is arranged such that all condensed effluent flowing through the discharge line 110 passes through the orifice 114. The discharge line 110 fluidly couples the separator 26 and the first and second filters 30, 34 to the electric heater 38. The electric heater 38 (e.g., an electric pass-through heater or tankless water heater) includes a heater inlet 126 and a heater outlet 130. Further, the electric heater 38 electrically couples to the power source (not shown). In the illustrated construction, the heater outlet 130 is open to the atmosphere.

The controller 50 is preferably a microprocessor-based controller that electrically couples to the compressor 14 and the electric heater 38 to control various operational parameters of both the compressor 14 and the electric heater 38. Further, the controller 50 electrically couples to the compressor temperature sensor 58, the compressor pressure sensor 62, the ambient air temperature sensor 66, the ambient air relative humidity sensor 68, and the heater temperature sensor 54.

The compressor temperature sensor 58 and compressor pressure sensor 62 couple to the compressor 14. For example, the sensors 58, 62 may be disposed in a compressor discharge line or downstream of the compressor 14 to directly measure the temperature and pressure of the compressed air exiting the compressor 14. The sensors 58, 62 generate temperature and pressure signals indicative of the measured temperature and pressure of the compressed air and transmit the temperature and pressure signals to the controller 50. The ambient air temperature sensor 66 and the ambient air relative humidity sensor 68 couple to the compressor 14 near the compressor air inlet 70. The sensors 66, 68 generate temperature and relative humidity signals indicative of the measured temperature and relative humidity of the ambient air entering the compressor 14 and transmit the temperature and relative humidity signals to the controller 50. Based on the signals from the sensors 58, 62, 66, 68, the controller is configured to utilize a predictive algorithm to "ready" (e.g., preheat or otherwise adjust the temperature and/or energy flow in anticipation of a change in conditions) the electric heater 38 and prepare the electric heater 38 to vaporize effluent. The heater temperature sensor 54 couples to the electric heater 38. For example, the heater temperature sensor 54 may be disposed inside a discharge line of the electric heater 38 to directly measure the temperature of the vaporized effluent exiting the electric heater 38. The heater temperature sensor 54 generates a temperature signal indicative of a measured temperature of the vaporized effluent and transmits the temperature signal to the controller 50.

The signals from the compressor pressure sensor 62, the compressor temperature sensor 58, the ambient air temperature sensor 66, the ambient air relative humidity sensor 68, and the heater temperature sensor 54 are used in determining how the compressor 14 and/or electric heater 38 are operated. In other constructions, the operation of additional components can be determined by the signals from the sensors 54, 58, 62, 66, 68 (e.g., the motor 18 or the power source). Further, in alternative constructions, additional sensors 54, 58, 62, 66, 68 may be utilized in similar positions as those described above, or in additional positions in and around the compressor 14 and the electric heater 38. In preferred constructions, the sensors 54, 58, 62, 66, and 68 transmit analog or digital signals to the controller 50.

Figure 2:
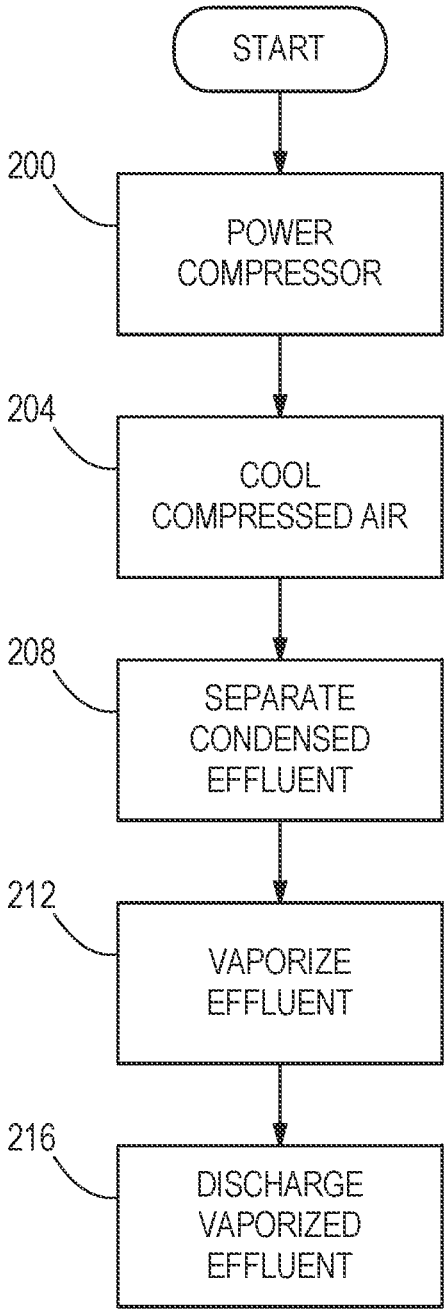
FIG. 2 is a flow chart illustrating a method of operating the condensate vaporization system of FIG. 1.

The flowchart of FIG. 2 illustrates operation of the condensate vaporization system 10 starting with block 200. The power source provides power to the motor 18, which drives the compressor 14. The compressor 14 intakes air through the compressor air inlet 70 from the surrounding atmosphere. Further, in the illustrated embodiment, a pump (not shown) provides oil to the compressor 14. The compressor 14 compresses the air, and directs the air outward through the compressor discharge end 78. During the compression process, oil is used to seal the compressor 14 and to cool the compressor 14. As air is discharged, a small portion of oil is entrained with the air. In addition, the compression process can cause some moisture to condense within the air stream. The compressed air directed outward from the compressor 14 includes this water vapor, oil vapor, and oil additive vapors in the form of an entrained effluent.

The aftercooler 22 receives the compressed air at the aftercooler inlet 82 and cools the air (see block 204) by allowing thermal communication between the compressed air and the cooling fluid. Cooling the compressed air condenses a first portion of the entrained effluent. The aftercooler 22 then directs the compressed air and the first portion of condensed effluent through the aftercooler outlet 86 to the separator inlet 90.

The separator 26 separates the first portion of the condensed effluent from the compressed air and directs the first portion through the second separator outlet 98 to the discharge line 110 (see block 208). The separator 26 then directs the compressed air through the first separator outlet 94 to the first and second filters 30, 34.

In the illustrated construction, the first filter 30 separates a second portion of condensed effluent from the compressed air. The second portion of condensed effluent passes to the discharge line 110. The compressed air passes to the second filter 34. The second filter 34 separates a third portion of condensed effluent from the compressed air. The third portion of condensed effluent passes to the discharge line 110. The compressed air exits out of the particulate removal system 15 in the form of dry compressed air. In preferred constructions, the air is heated after exiting the filters to assure that the air temperature is well above the air's dew point temperature. Generally, dry compressed air has a dew point at least 20 degrees below the discharge temperature of the air. The first, second, and third portions of condensed effluent pass through the discharge line 110 and through the orifice 114. The condensed effluent (e.g., the first, second, and third portions) then pass through the heater inlet 126 to the electric heater 38. The orifice 114, in some constructions, is selected specifically to control the amount of compressed air lost and to allow the condensate to escape at the rate accumulated. In other embodiments, a check valve or pressure reducing valve may be used to decrease the pressure of the condensed effluent. The power source powers the electric heater 38 to heat the condensed effluent in the electric heater 38. The electric heater 38 heats the condensed effluent to a temperature at which water, as well as some additional effluent constituents, will vaporize. A temperature control can also be employed to limit the temperature and to control vaporizing of the effluent constituents as desired (see block 212). In other constructions, additional electric heaters may be included to provide additional heating to the condensed effluent. Further, the additional heaters may be arranged with the electric heater 38, downstream of the discharge line 110, either in series or in parallel. The vaporized effluent then passes through the heater outlet 130 to the atmosphere (see block 216).

Referring again to FIG. 1, the controller 50 controls the amount of electricity provided to the electric heater 38 by the power source. The compressor temperature sensor 58 detects the temperature of the compressor 14 and sends compressor temperature measurements to the controller 50. The compressor pressure sensor 62 detects the pressure in the compressor 14 and sends compressor pressure measurements to the controller 50. The ambient air temperature sensor 66 detects the temperature of the ambient air entering the compressor 14 and sends the ambient air temperature measurements to the controller 50. The ambient air relative humidity sensor 68 detects the relative humidity of the ambient air entering the compressor 14 and sends the ambient air relative humidity measurements to the controller 50. The heater temperature sensor 54 detects the temperature of the electric heater 38 and sends heater temperature measurements to the controller 50.

The controller 50 receives the compressor temperature measurements, the compressor pressure measurements, the ambient air temperature measurements, the ambient air relative humidity measurements, and the heater temperature measurements. Based on one or more of these measurements, the controller 50 determines and controls the amount of electricity that is provided to the electric heater 38 to ensure that the condensed effluent within the electric heater 38 is fully vaporized. Further, based on the signals from the sensors 58, 62, 66, 68, the controller 50 may utilize a predictive algorithm to "ready" (e.g., preheat or otherwise adjust the temperature and/or energy flow in anticipation of a change in conditions) the electric heater 38 and prepare the electric heater 38 to fully vaporize the condensed effluent for a given demand (i.e., kilowatt input or heat load). Further, the ambient temperature and relative humidity measurements allow the controller 50 to determine the total amount of water coming into the system to better estimate the amount of heat required to fully vaporize the effluent.

Various features and advantages of the invention are set forth in the following claims.

What is claimed is:

1. An air compressor system comprising:

a compressor having an intake end and a discharge end, the compressor operable to draw in atmospheric air at the intake end and to discharge a flow of compressed air from the discharge end, the flow of compressed air including a flow of entrained water vapor and oil;

a separator operable to remove a portion of the entrained water vapor and oil from the flow of compressed air, the separator discharging a flow of dry compressed air and a flow of effluent, the effluent including at least the separated water vapor and the oil; and an electric heater configured to receive the effluent from the separator and to vaporize the effluent.

2. The air compressor system of claim 1, wherein the system includes an aftercooler coupled to the discharge end of the compressor and an intake end of the separator, the aftercooler operable to cool the compressed air and effluent to condense a portion of the effluent.

3. The air compressor system of claim 1, wherein the electric heater directs vaporized effluent to atmosphere through a discharge of the electric heater.

4. The air compressor system of claim 1, wherein the electric heater is configured to heat the effluent to a temperature that at least the separated water vapor and the oil vaporize.

5. A method of operating an electrically-powered air compressor, the method comprising:

powering an oil-flooded compressor to produce a flow of compressed air and effluent, the effluent including compressed water vapor and oil;

cooling the flow of compressed air and effluent to condense a portion of the effluent;

separating the flow of compressed air and effluent into a flow of dry compressed air and a flow of condensed effluent;

heating the flow of condensed effluent in an electrically-powered heater to vaporize the effluent; and discharging the vaporized effluent to the atmosphere.

6. The method of claim 5, wherein the powering step includes powering the compressor with an electric motor.

7. An air compressor system comprising:

a compressor having an intake end and a discharge end, the compressor operable to draw in atmospheric air at the intake end and to discharge a flow of compressed air from the discharge end, the flow of compressed air including a flow of entrained water vapor and lubricant;

a separator operable to remove a portion of the entrained water vapor and lubricant from the flow of compressed air, the separator discharging a flow of dry compressed air and a flow of effluent which includes the separated water vapor and lubricant; and an electric heater configured to receive the effluent from the separator at an entrance to the electric heater and to vaporize the effluent.

8. The air compressor system of claim 7, wherein the system includes an aftercooler coupled to the discharge end of the compressor and an intake end of the separator, the aftercooler operable to cool the compressed air and effluent to condense a portion of the effluent.

9. The air compressor system of claim 7, wherein the separator includes a moisture separator configured to remove a portion of the effluent from the compressed air flow and direct the portion of effluent to an entrance of the electric heater, wherein the separator includes at least one filter configured to remove a second portion of effluent from the compressed air flow and direct the second portion of effluent to the entrance of the electric heater.

10. The air compressor system of claim 7, wherein the electric heater directs vaporized effluent to atmosphere through an exit of the electric heater.

11. The air compressor system of claim 7, wherein the system includes a controller in operable communication with the compressor.

12. The air compressor system of claim 11, wherein the system includes a temperature sensor coupled to the electric heater and configured to send a temperature measurement to the controller.

13. The air compressor system of claim 11, wherein the system includes a pressure sensor coupled to the compressor configured to send a pressure measurement to the controller.

14. The air compressor system of claim 11, wherein the system includes a compressor temperature sensor coupled to the compressor and configured to send a compressor temperature measurement to the controller.

* * * * *